US006068028A

United States Patent [19]

De Ro et al.

[11] Patent Number: 6,068,028

[45] Date of Patent: May 30, 2000

[54] YARN SCANNING PROCESS AND YARN UNWINDING SENSOR

[75] Inventors: Ignace De Ro, Ypres, Belgium; Henrik Lilja, Angered, Sweden

[73] Assignees: Iro AB, Ulrichehamn, Sweden; Picanol N.V., Ypres, Belgium

[21] Appl. No.: 08/983,365

[22] PCT Filed: Jul. 18, 1996

[86] PCT No.: PCT/EP96/03177

§ 371 Date: May 18, 1998

§ 102(e) Date: May 18, 1998

[87] PCT Pub. No.: WO97/04151

PCT Pub. Date: Feb. 6, 1997

[30] Foreign Application Priority Data

Jul. 18, 1995 [DE] Germany ..... 195 26 216

[51] Int. Cl.[7] ..... D03D 47/36

[52] U.S. Cl. ..... 139/452; 242/364.8; 364/470.15

[58] Field of Search ..... 242/364.8; 364/470.15; 324/71.1; 139/452

[56] References Cited

U.S. PATENT DOCUMENTS

| | | | |
|---|---|---|---|
| 4,407,336 | 10/1983 | Steiner | 139/452 |
| 4,768,565 | 9/1988 | Tholander | 139/452 |
| 4,848,417 | 7/1989 | Dekker et al. | 139/452 |
| 4,877,064 | 10/1989 | Pezzoli | 139/452 |
| 5,613,528 | 3/1997 | Zenoni et al. | 139/452 |

FOREIGN PATENT DOCUMENTS

| | | |
|---|---|---|
| 889 255 | 12/1981 | Belgium . |
| 0 176 987 | 4/1986 | European Pat. Off. . |
| 0 286 584 | 10/1988 | European Pat. Off. . |
| 647 999 | 2/1985 | Switzerland . |

*Primary Examiner*—Andy Falik

*Attorney, Agent, or Firm*—Flynn, Thiel, Boutell & Tanis, P.C.

[57] ABSTRACT

In a method of scanning, with the aid of a sensor device, a yarn of a predetermined length which is intermittently withdrawn from a winding reservoir provided on the storage drum of a yarn feeding device for weaving machines, the yarn pulse acceptance for exclusively at least one first yarn pulse is changed at an increasing yarn speed and/or upon generation of at least one first or each winding signal to a yarn pulse acceptance for further faster yarn pulses and non-acceptance of interference pulses that are slower than the second yarn pulses. A yarn withdrawal sensor which is suited for said method is characterized in that a filtering device is provided with two different selective filtering modes that differ from each other by their acceptance of yarn pulses generated at different yarn withdrawal speeds, and that the filtering device is switchable at an increasing yarn withdrawal speed from a first filtering mode to at least one further filtering mode.

19 Claims, 6 Drawing Sheets

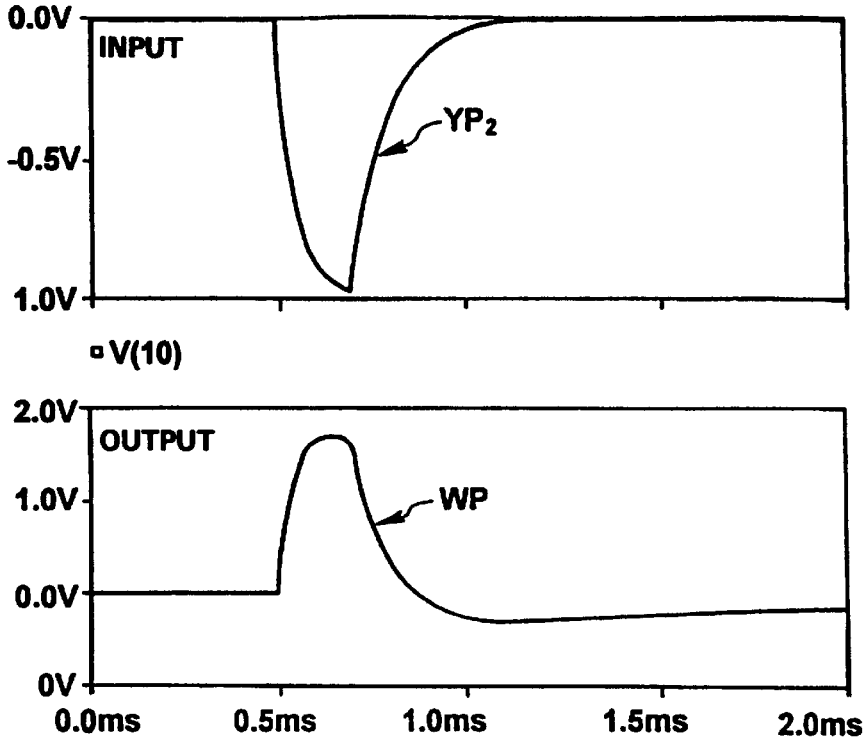
FIG. 8c
FIG. 8d
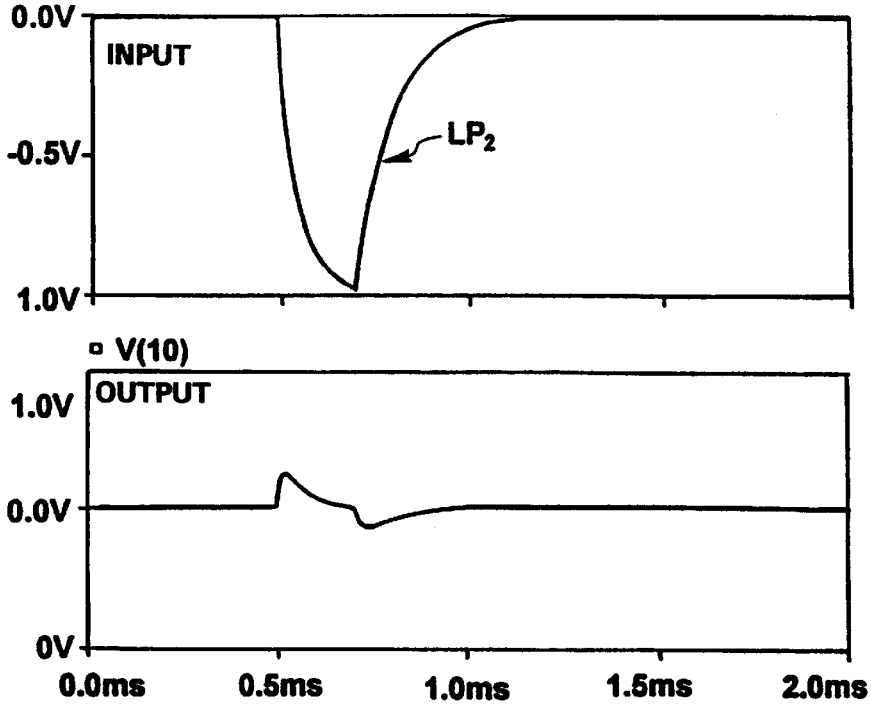
FIG. 8e
FIG. 8f

YARN SCANNING PROCESS AND YARN UNWINDING SENSOR

FIELD OF THE INVENTION

The present invention relates to a method and to a yarn withdrawal sensor therefor which accommodates interference pulses from a yarn sensor arrangement caused by dirt, lint or the like.

BACKGROUND OF THE RELATED ART

In a method which is described in CH-B-647 999, winding signals are produced from yarn pulses and are then counted. In practice, the correct number of winding signals sometimes represents a number of withdrawn windings that is either too great or too small, resulting in picks that are too short or too long. For it sometimes happens that a free lint cluster or a yarn component hanging onto the yarn (e.g. in multifilament yarns) is dragged behind a withdrawn yarn winding and below the withdrawal sensor and therebeyond, so that the sensor reports the cluster or component as an additional winding. By contrast, when two adjacent windings are withdrawn in close vicinity below the winding sensor, only one winding signal is produced for the two windings.

EP0 286 584 B1 discloses another method of this kind, in which yarn pulses of a plurality of circumferentially distributed withdrawal sensors are converted into winding signals, then supplied to an evaluation unit and compared with an expected signal pattern which corresponds to a predetermined time sequence of the winding signals during interference-free operation. The winding signals are only taken into account for the control of the weft-yarn store when the time sequence of the supplied winding signals complies with the expected pattern.

Furthermore, prior use in practice has revealed a method in which each yarn pulse is converted into a winding signal in a filter means assigned to the receiver of the withdrawal sensor and in which the winding signal helps to open a time window within which successive pulses or signals are ignored. Such a measure prevents lint clusters following at a lower speed from leading to winding signals within the time window. However, when two closely adjacent windings are withdrawn, then the second winding can no longer be detected, which leads to an excessively long pick.

In modern, fast air-jet weaving machines it sometimes happens for reasons which are not exactly understood that, for instance, once every 1000 insertion cycles there is an insertion in the case of which the yarn is inserted at a slower pace than has been predetermined. Such an insertion, however, is not to effect a shut-off of the weaving machine, for the insertion is per se correct, but only too slow. Furthermore, it has been found in practice that with specific yarn qualities not only lint clusters are separately entrained after the yarn windings, but yarn components which are still clinging to the yarn are also dragged along, e.g., in the case of multifilament yarns. Such lint clusters or clinging components then produce other types of pulses (with flat ramp and low frequency content) than the yarn itself. Such false yarn pulses caused by entrained yarn components are also not meant to produce winding signals. By contrast, two winding signals are actually to be produced when two windings are simultaneously withdrawn, as is sometimes the case. These above-mentioned circumstances create special requirements for the withdrawal sensor which is to make a reliable distinction between yarn windings and other objects.

It is the object of the present invention to provide a simple method of the above-mentioned kind and a yarn withdrawal sensor for performing said method with the help of which short and long picks are avoided when using a measuring and feeding device a weaving machine.

SUMMARY OF THE INVENTION

This object is achieved with the yarn withdrawal sensor and method therefor wherein filter means such as a band-pass filter assembly is shiftable between first and second filtering modes to prevent processing of interference pulses.

The method prevents the production of wrong winding signals due to lint clusters or other dirt moving at a pace slower than the yarn or producing weak interference pulses, since the set yarn pulse acceptance for strong and fast yarn pulses rules out a situation where the filtering means accepts the slower or weak interference pulse of a lint cluster. A finding which has been made in practice is here taken into account, i.e., the finding that during the initial slow yarn withdrawal in the acceleration phase of the insertion cycle there are hardly any passing lint clusters or contaminations at any rate. Such interference is most of the time only observed during fast yarn withdrawal after the acceleration phase. Thanks to the division of each insertion process into at least one portion for low yarn speed and into at least one portion for increased yarn speed, the division being performed by intentionally varying the yarn pulse acceptance, all sorts of yarn pulses are properly recorded, but no winding signals are produced from interference pulses. If use were only made of an unvaried broad yarn pulse acceptance equally suited for slow and fast yarn pulses, no distinction could be made between slow and correct initial yarn pulses and interference pulses at a higher yarn speed because the interference pulses (caused by moving dirt) would lead to winding signals during scanning as does(do) also the slow initial yarn pulse(s). A special advantage is here that the method properly produces two winding signals also in the case of two yarn windings passing shortly one after the other through the withdrawal sensor without the yarn pulse of the second one of said two yarn windings being lost. Since the winding signal information for measuring the predetermined yarn length is reliable and unalterable, weft yarns which are too short or too long are avoided despite unavoidable dirt and despite the fact that some windings are sometimes withdrawn at almost the same time. The steps of the method can also be carried out manually in case of repair work or when a yarn feeding device is adjusted for the first time or is run in. A strong or fast "pulse" means an electrical signal which has a steep ramp and a high frequency portion. A weak or slow "pulse" has no steep ramp and a small frequency portion.

In the yarn withdrawal sensor, the at least first yarn pulse and above all the fast yarn pulses are distinguishable from slow or weak interference pulses with the aid of the two different selective filtering modes. The second selective filtering mode does not accept any interference pulses which would be slower or weaker than the strong yarn pulses. As for the interference pulses caused by dirt, it should be noted that lint clusters have most of the time an increased extension in the direction of passage below the withdrawal sensor and also a different appearance, so that the interference pulse is detected to be a slower or weaker one not only because of the low speed of movement of such a contamination, e.g. a lint cluster, but also because of the increased extension and the other characteristic, e.g. reduced density. An interference pulse caused by dirt has a leading ramp which is not so steep and a frequency portion (frequency content) smaller than that of the previous strong yarn pulse, the leading ramp of the respective pulse being an important criterion for the derivation of the winding signal. The respective acceptance or the respective filtering mode is chosen such that "slow or weak" interference pulses are filtered out.

BRIEF DESCRIPTION OF THE DRAWINGS

Embodiments of the subject matter of the invention will now be explained with reference to the drawings, in which:

FIGS. 8*a*–8*h* show the response characteristics of the withdrawal sensor.

DETAILED DESCRIPTION

Figure 1:
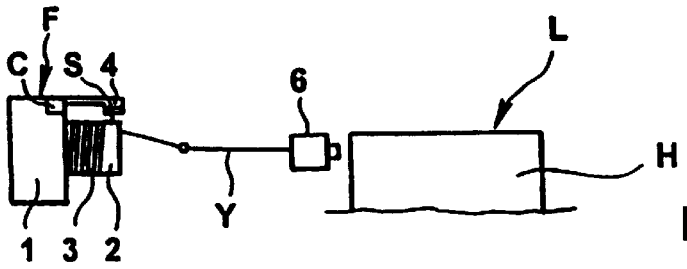
FIG. 1 is a diagrammatic side view of a weaving machine including a measuring and feeding device.

FIG. 1 diagrammatically illustrates a weft-yarn feeding device F (measuring and feeding device) of known construction which supplies a weft yarn Y intermittently and at a respectively exactly dimensioned identical length to a shed H of a weaving machine L, e.g., a jet loom. Yarn Y is withdrawn from a supply coil (not shown), it is passed through a motor housing 1 and wound in a winding reservoir 3 onto a storage drum 2 from which it is withdrawn below a stop device 4 and overhead by means of an insertion device 6, e.g., an insertion nozzle. The stop device 4 is oriented with a stop element towards a withdrawal region of the storage drum 2. Stop element 5 is activated and deactivated for proportioning the yarn length by means of a control device C. In the activated state of stop element 5, yarn Y is retained. In the deactivated state of stop element 5, yarn Y can freely be unwound from the winding reservoir 3. Winding reservoir 3 is replenished with the help of a drive (not shown) of the feeding device F in the customary manner so that new yarn is wound up. With the aid of a withdrawal sensor S, a winding signal is produced during each passage of yarn Y through a scanning portion positioned below the withdrawal sensor S. The winding signals will be counted until the predetermined yarn length has been reached. The stop element 5 is then activated again. The circumferential length of the storage drum may be variable for adjusting a predetermined yarn length for all insertion cycles.

Figure 2:
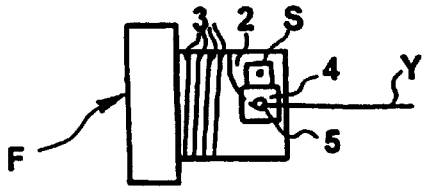
FIG. 2 is a diagrammatic top view onto the measuring and feeding device of FIG. 1.

FIG. 2 is a top view on the feeding device F, in which the withdrawal sensor S is arranged in the motional direction of yarn Y just behind the stop element 5 during withdrawal (arrow), expediently offset in the axial direction of storage drum 2 relative to the stop element 5, e.g. by about 1 cm, to ensure a relatively high passage speed of yarn Y at a receiver R of the withdrawal sensor S at all times. Yarn Y extends from the last winding of the winding reservoir 3 in a direction oblique to stop device 4, it is deflected at stop element 5 in the activated state of said stop element 5 and extends away from stop element 5 at the widthdrawal side approximately in axial direction.

In modern weaving machines L, yarn speeds of up to 100 m/s or more are observed during insertion. However, the yarn Y must first be accelerated to reach its maximum yarn speed after each deactivation of stop device 4, 5. This means that after the deactivation of stop element 5 yarn Y passes through the withdrawal sensor S at a relatively low speed of, for instance, slightly more than 2 m/s—at least the first time, but already runs at a substantially higher speed (in the direction of the arrow) during its next passage underneath the withdrawal sensor S. With most yarn qualities, contaminations, such as lint clusters which are entrained during unwinding of the yarn and possibly also pass through the scanning portion below the withdrawal sensor S, can be in yarn reservoir 3. Such dirt, however, normally moves at a slower pace than the yarn and it is recorded by the withdrawal sensor more slowly than the yarn. Yarn components which extend away from the yarn may also be entrained; such components, however, also produce weak interference pulses.

Figure 3:
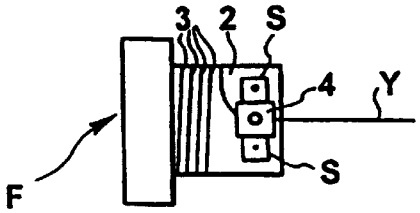
FIG. 3 shows an alternative embodiment of a measuring and feeding device.

FIG. 3 shows a modified embodiment of a feeding device F in which a withdrawal sensor S is respectively arranged at both sides of the stop device 4 at a short distance. The two withdrawal sensors S form, for instance, one winding signal based on the two yarn passages. Thanks to the two withdrawal sensors S, the feeding device F can selectively be operated in the one or the other rotational direction. It is possible to then use only one of the two withdrawal sensors S.

Figure 4:
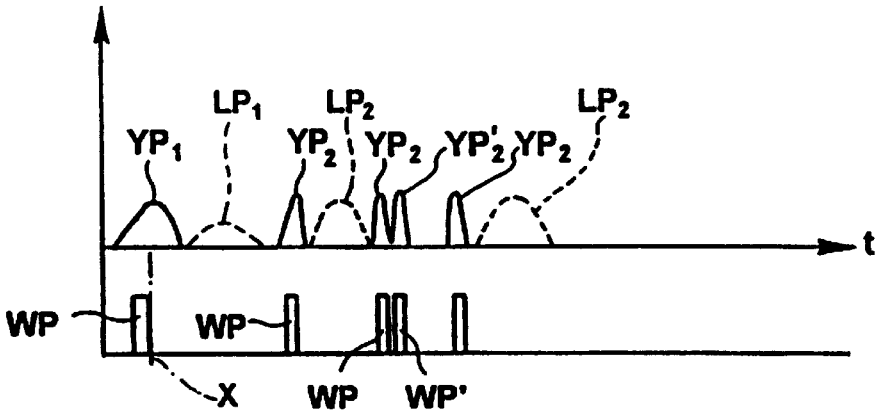
FIGS. 4 and 5 schematically show a first type of method, wherein the upper diagram represents yarn and interference pulses as well as winding signals generated from the yarn pulses, whilst the lower diagram illustrates frequency bandwidths which are assigned to specific yarn speed ranges.

In FIG. 4, the upper diagram part illustrates (electric) yarn pulses effected by the yarn Y in the withdrawal sensor S of FIGS. 1 and 2 during an insertion cycle. After stop element 5 has been deactivated, a first slow and weak yarn pulse YP1 is first produced, the speed of said yarn pulse YP1 being respresented by the width and a relatively flat leading ramp. The next occurring yarn pulses YP2 are faster and stronger, which is expressed by their steeper leading ramp (higher frequency portion or content) and their pointed shape. Interference pulses LP1 and LP2, which are outlined in broken line, are caused by dirt or by yarn components that are possibly torn away during withdrawal and pass through the scanning portion behind the yarn. The first interference pulse LP1 is slower and weaker than the first yarn pulse YP1, however, said interference pulse LP1 being very unlikely for the reason that, at the beginning of the withdrawal process, dirt is hardly entrained because of the slow withdrawal speed of the yarn and because of the absence of any pronounced air turbulences or dynamics. Normally, such an effect is only observed at an increased yarn speed. The further interference pulses LP2 are slower or weaker than the faster yarn pulses YP2. It may also happen, particularly in the dynamic phase during an insertion cycle, that two yarn windings are removed from the winding reservoir 3 and are unwound almost simultaneously, i.e., in close vicinity next to each other. Such a situation is demonstrated in FIG. 4 by the second faster yarn pulse YP2 and the directly following faster yarn pulse YP2'.

The lower diagram part of FIG. 4 shows how winding signals WP are produced for the control device C from the yarn pulses YP1, YP2, YP2'. A winding signal WP which is representative of the yarn passage is produced on the basis of the first yarn pulse YP1. As soon as, for instance, the first winding signal WP has been recorded, the withdrawal sensor S is switched over or adjusted such that it only produces winding signals WP on the basis of faster and strong yarn pulses YP2, YP2'. The adjustment is made at time X. After the adjusting process the withdrawal sensor does not produce any winding signals WP from the slower or weaker interference pulses LP2. False winding signals caused by such interference pulses are thereby avoided. By contrast, two winding signals WP and WP'are produced in a proper manner even when two neighboring windings (two strong yarn pulses YP2, YP2') are unwound almost simultaneously.

Figure 5:
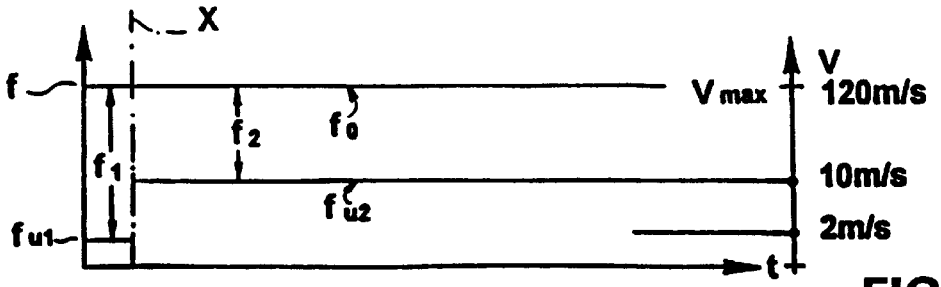
Figure 6:
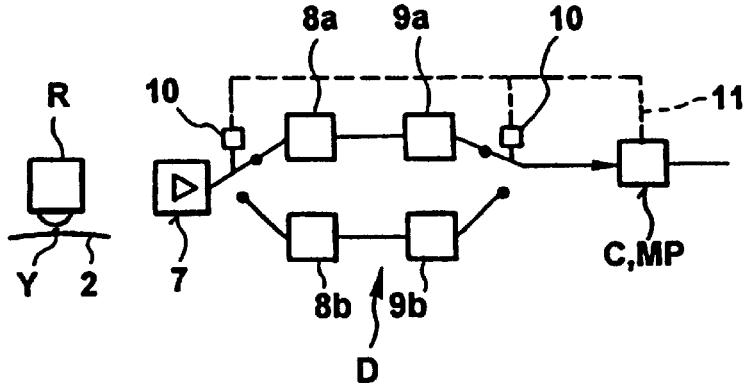
FIG. 6 shows a schematic block diagram of a simplified embodiment of a circuit of a withdrawal sensor.
Figure 7:
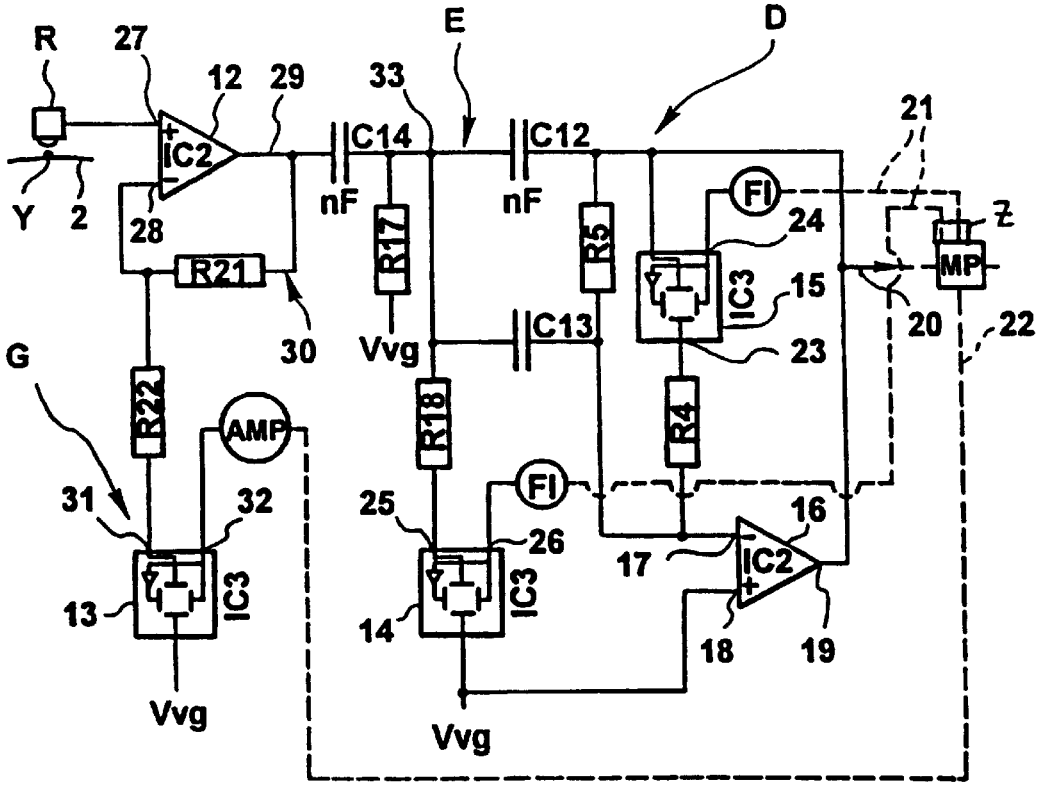
FIG. 7 shows a detailed block diagram of an electric circuit of a withdrawal sensor.

Each yarn pulse is electrically produced and processed in an electric filter assembly E (FIGS. 6 and 7). The filter assembly includes, for instance, bandpass filters the frequency bands of which are outlined in FIG. 5. In the first set mode of the withdrawal sensor, the filter assembly operates with a frequency range f1 between a lower frequency limit fU1 and an upper frequency limit fO. fU1 corresponds, for instance, to a minimum yarn speed of 2 m/s. fO corresponds, for instance, to a speed of 120 m/s of the yarn (Vmax). At time X the filter assembly is upshifted to a different frequency range f2 whose lower limit fU2 is higher than the lower limit fU1. fU2 corresponds, for instance, to a minimum yarn speed of 10 m/s. In the second set mode after time X the upper limit fO is the same as before.

In the set mode of the withdrawal sensor before time X, the at least first slow and weak yarn pulse YP1 is just about accepted. After time X fast and strong yarn pulses YP2, YP2'are accepted, whereas slow or weak interference pulses LP2 are not accepted.

Upon deactivation of stop element 5, the first frequency range f1 is set. After generation of the first winding signal WP, there is switching over to the second frequency range f2 either with the help of this winding signal or possibly with the second winding signal, or in response to the known increase in yarn speed at time X. When the stop device is again activated, the filter assembly is again reset into the first range f1.

For repair work or adjustments or for running in the yarn feeding device, the withdrawal sensor may also be switched over by hand, the automatic position which is employed during normal operation of the yarn feeding device being then neutralized.

Figure 4A:
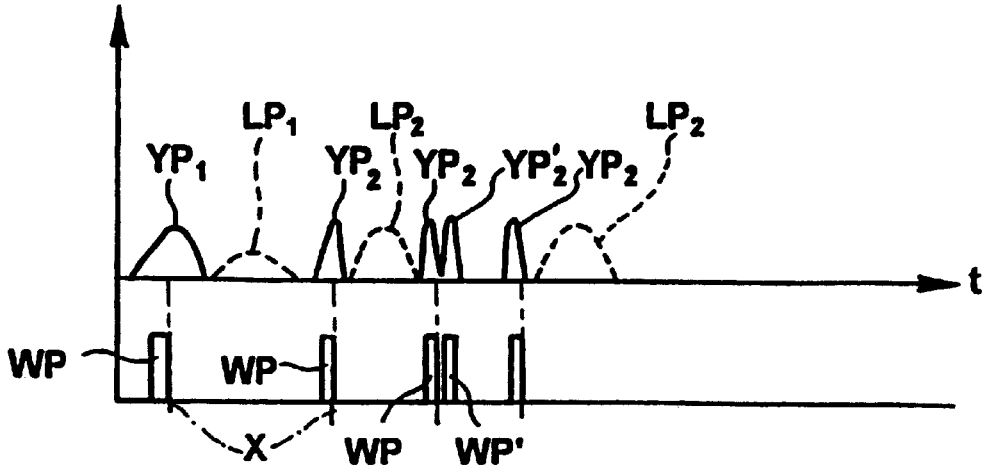
FIGS. 4A and 5A show two diagrams of a second variant of the method, corresponding to FIGS. 4 and 5.
Figure 5A:
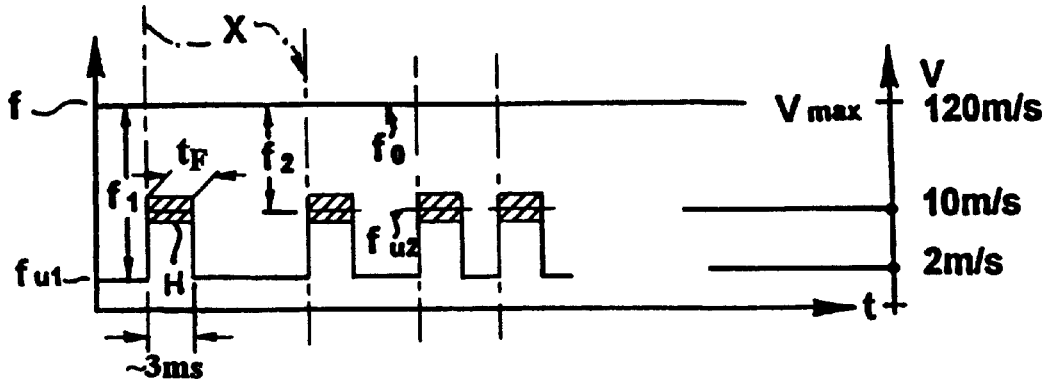

The diagrams of FIGS. 4A and 5A represent variants of the method in which the filtering mode f1 is adjusted prior to the generation of each winding signal WP, and in which upon generation of each winding signal WP there is switching over to the further filtering mode f2. An upshifting signal which is maintained over a time window H whose duration $t_F$ is uniformly predetermined, e.g. at 3 ms, is respectively produced at time X. The time window H is opened by means of the counting or timing member Z of FIG. 7, for instance by each winding signal WP, and upon output of the upshifting signal Fl at time X. After the time window H has expired, there is again downshifting to filtering mode f1. If there is switching between the filtering modes during the whole insertion cycle, detection errors are also avoided during a slow insertion that is not observed very often. The time window H is outlined in FIG. 5A only diagrammatically and not true to scale. It should extend over a period of time within which the passage of dirt must be expected.

FIGS. 8*a*–8*h* are concrete function diagrams of the withdrawal sensor S.

Figure 8A:
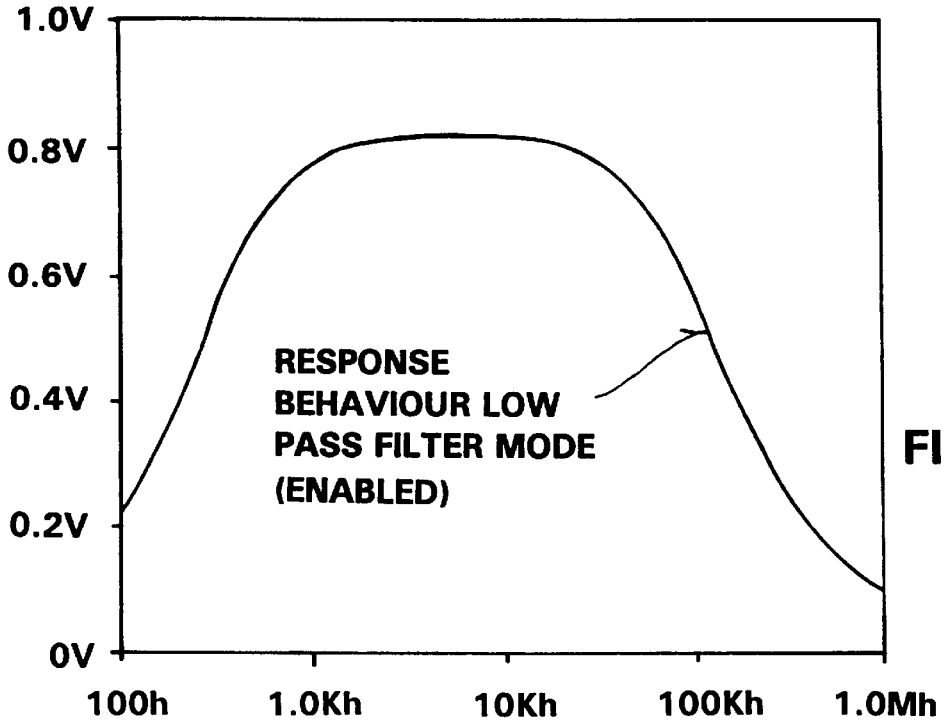
Figure 8B:
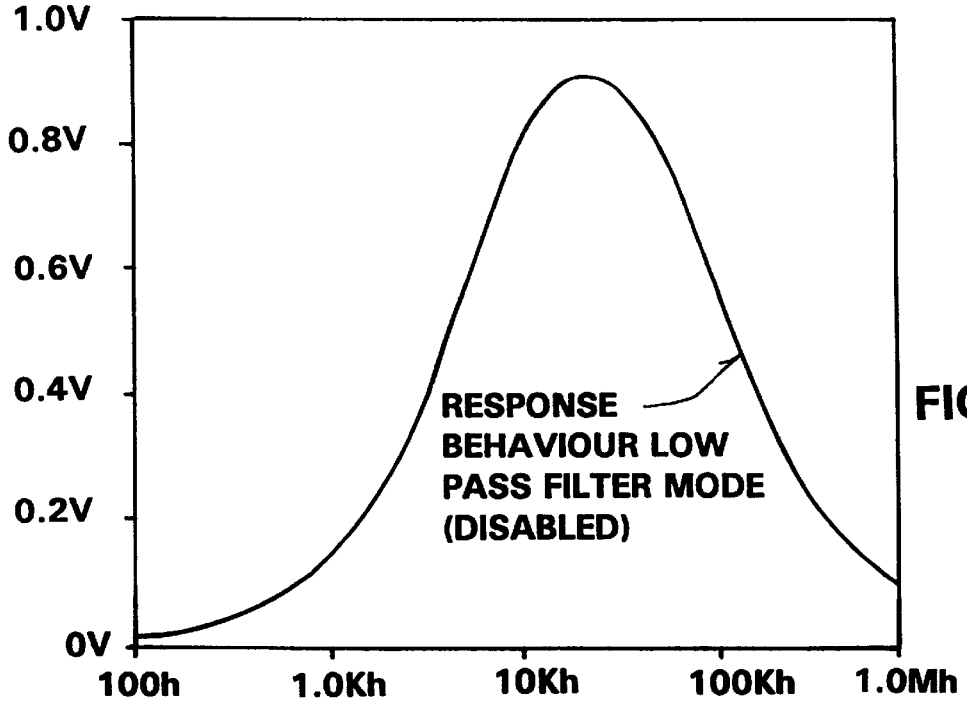

The diagrams (d.c. voltage across the logarithmically represented frequency) of FIGS. 8*a* and 8*b* represent the response characteristics of the band-pass filter assembly to yarn pulses. In FIG. 8*a*, a high-pass filter mode and a low-pass filter mode are operative at the same time. The filter assembly has a spread response range in which frequencies which are clearly below 1.0 kHz already yield a d.c. voltage level of 0.6 V or more, a d.c. level of about 0.8 V is obtained over a frequency range of from 1.0 kHz to about 20 kHz, and a d.c. voltage level of about 0.6 V is even obtained at a frequency of 100 kHz.

In FIG. 8*b* the low-pass filter mode has been disabled, so that the response characteristics in the diagram of the d.c. voltage across the frequency in the upper frequency range remain approximately the same as in FIG. 8*a*, but are different in the lower frequency range. A frequency which is clearly below 10 kHz just yields a d.c. voltage of 0.6 V, frequencies between 10 kHz and 70 kHz yield d.c. voltage levels of 0.8 V and more, and frequencies of 100 Hz to about 7.0 kHz yield d.c. levels which are clearly below 0.6 V.

FIG. 8*c* illustrates the input signal to the band-pass filter means in the form of a d.c. level curve over time (ms) during the first yarn passage, the input signal extending up to a d.c. voltage value of about −1.0 V and lasting for about 0.5 ms. The associated diagram of FIG. 8*d* represents the associated output signal of the band-pass filter assembly after response to the signal shown in the diagram of FIG. 8*c*. As can be seen, a strong output signal with an absolute d.c. voltage value of almost 2.0 V over approximately 0.5 ms is observed in the response characteristics according to FIG. 8*a* (low-pass filter mode and high-pass filter mode).

FIGS. 8*e* and 8*f* are diagrams (d.c. voltage over time) which represent the input signal to and the output signal from the band-pass filter assembly, i.e. in the case of response characteristics according to FIG. 8*b* (low-pass filter mode disabled) and with the same input signal as in FIG. 8*c*, i.e., during passage of dirt with a pulse format corresponding to a yarn pulse format. Since the signal curve in FIG. 8*e* contains only weak or few frequency portions due to reduced steepness of its leading or trailing edge, respectively, a level of less than 0.1 V is just obtained as the output signal of the band-pass filter means in FIG. 8*f*, which is ignored and does not lead to a useful signal.

Figure 8G:
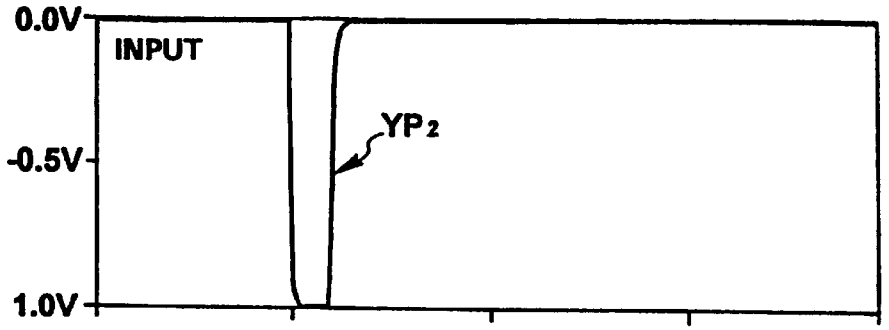
Figure 8H:
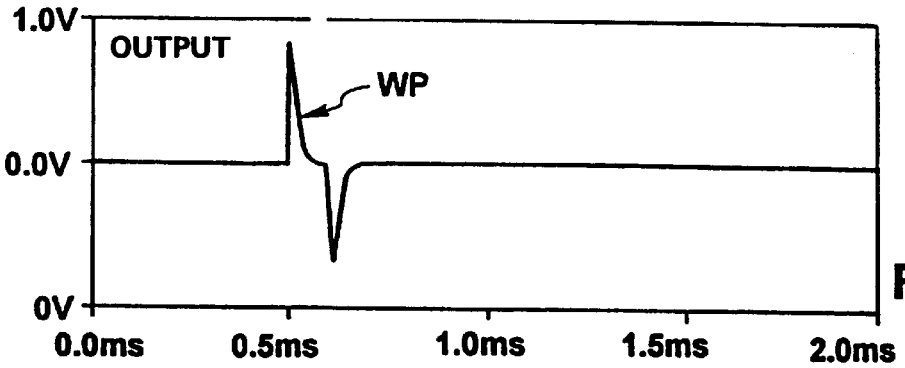

FIGS. 8*g* and 8*h* represent the response of the band-pass filter assembly to a faster yarn pulse YP2 which is shown in the diagram of FIG. 8*g* (voltage over time) as a strong signal of up to −1.0 V over a period of about 0.1 ms and with a virtually vertical drop and vertical rise, i.e. a high frequency portion. This is the input signal of the band-pass filter assembly from which the output signal of FIG. 8*h* is produced in the band-pass filter assembly, which output signal is obtained as a distinct winding signal WP with a voltage level of about 1.0 V and a subsequent drop to almost −1.0 V and which can clearly be distinguished from the considerably weaker signal of FIG. 8*f* caused by an interference pulse LP2.

FIG. 6 diagrammatically illustrates an embodiment of a circuit D of the withdrawal sensor S between a receiver R and control unit C or a microprocessor MP. The yarn pulse produced by receiver R is supplied to an operational amplifier 7 behind which, in this embodiment, two band-pass filters 8*a* and 8*b* are arranged in parallel, said band-pass filters 8*a* and 8*b* having respectively arranged downstream thereof members 9*a*, 9*b* for producing the winding signals. The two band-pass filters 8*a* and 8*b* have different frequency ranges f1, f2. A switching device 10 is connected via a line 11 to control C and microprocessor MP, respectively, and is switchable between two switching positions to activate either the one branch or the other branch of the filter assembly. Upshifting (and resetting) is performed by way of an upshifting signal (and resetting signal, respectively) from the control device or microprocessor C, MP, i.e., either upon generation of the at least first winding signal or in response to the yarn speed which is normally measured, i.e. when a predetermined yarn speed is reached that is representative of the yarn having passed through the withdrawal sensor for the first time, or with each winding signal (FIGS. 4A, 5A).

FIG. 7 shows a circuit having a band-pass filter assembly E and a sensitivity adjusting device G with the aid of which the withdrawal sensor S can be adapted to the respective yarn quality and working conditions. Receiver R is connected to a positive input 27 of an operational amplifier 12 from the output 29 of which a feedback loop 30 leads to the negative input 28 thereof. A resistor R21 is accommodated in the feedback loop 30. A terminal 31 of an analog circuit component 12 which is virtually grounded at Vvg is connected between resistor R21 and the negative input 28 via a resistor R22. At 32, a sensitivity adjusting signal AMP can be applied to the analog circuit component 12, for instance a higher or a lower voltage level (digital 1 or 0) which is provided via a line 22 by microprocessor MP.

A capacitor C14 and a resistor R17 behind which a virtually grounded junction 33 is provided are arranged downstream of the output 29 of the operational amplifier 12. Capacitors and resistors C12, R5 and C12, R4, R18, R5 are provided in parallel behind said junction 33. Capacitor C12 is directly connected to a winding signal output 20, and, in addition, via resistor R5 to an output 17 of a further operational amplifier 16. The input of capacitor C13 is connected via resistor R18 to a terminal 25 of a further analog circuit component 14 which is virtually grounded and has a terminal 26 to which an upshifting signal Fl can be applied, typically a voltage level which is provided via a line 21 by microprocessor MP, e.g. upon receipt of the first or a respective winding signal WP.

The output of capacitor C13 is also connected to the negative input 17 of the operational amplifier 16 whose output 19 is connected to the winding signal output 20. The positive input 18 of the operational amplifier 16 is virtually grounded (VVg). A further analog circuit component 15 is arranged between the negative input 17 of the operational amplifier 16 and the line which extends from capacitor C12 to the winding signal output 20, a resistor R4 being used between the terminal 22 thereof and the negative input 17. A terminal 24 of the analog circuit component 15 can be fed with the upshifting signal Fl which is provided via a line 21 by microprocessor 20. The microprocessor MP may have a timing or counting member Z to maintain the upshifting signal Fl via a predetermined period ($t_F$ in FIG. 5A) upon generation of the winding signal WP, for instance over 3 ms. The period $t_F$ is shorter than the time interval between two winding signals WP at maximum withdrawal speed (e.g. 10 ms), preferably and for reasons of safety even shorter than half this time interval.

The sensitivity adjusting signal AMP is either a low or a high voltage level. Similarly, the upshifting signal Fl is produced as a high voltage level (digital 1 or 0).

In FIG. 7, no upshifting signal Fl is present at inputs 24 and 26 of the analog circuit components 14, 15 (i.e. a digital "0"). Hence, the frequency range f1 has been selected and the low-pass filtering mode has been enabled. In response to the yarn quality and the working conditions, there is either a digital 1 or a digital 0 present as the sensitivity adjusting signal AMP. A winding signal which is received by the microprocessor MP is produced from the at least first yarn pulse. Thereupon, a "digital 1" is produced as the upshifting signal Fl. The circuit is switched over to the second frequency range f2 (low-pass filtering mode disabled), whereby the anlog circuit components 14, 15 change the resistance characteristics of resistors R4, R18. To prevent such a change from influencing the sensitivity adjustment, the circuit components 13, 15, 14 are grounded and junction 33 is also grounded to ensure that the respective d.c. level will not drift off as soon as there is a switching operation. An impact on the sensitivity adjusting device G is thereby avoided. Such an impact is mainly operative by changing the amplifier factor in the operational amplifier 12. When a digital "0" is present as the sensitivity adjusting signal AMP, the amplification factor is, for instance, "1". When a digital "1" is present as the AMP, the amplification factor is 1+R21:R22. When the yarn is stopped after insertion or when the microprocessor MP no longer receives a winding signal over a long period of time or when the time window H in FIG. 4A, 5A has expired, the circuit D is reset via line 21 to the adjustment of the first frequency range f1.

The withdrawal sensor S is not necessarily arranged in the same radial plane as the stop device. The withdrawal sensor S could also be arranged in axial direction at the side of the stop device which is oriented away from the winding reservoir, i.e. also in front of the face of storage drum 2.

As discussed herein, the band-pass filtering means switches from a first filtering mode to a second filtering mode as soon as the first yarn pulse has led to the first winding signal. The subsequent yarn pulses are then so fast and strong that they are accepted in the second filtering mode whereas "slow or weak" interference pulses are not accepted.

In a particularly expedient variant of the method, prior to each arising yarn pulse or winding signal, the yarn pulse acceptance is temporarily adjusted for a weak yarn pulse before the yarn pulse acceptance is again changed subsequently with the winding signal to the yarn pulse acceptance for faster and strong yarn pulses. Thanks to the yarn pulse acceptance for faster and strong yarn pulses, which is only set for a short period of time, slow or weak interference pulses are prevented from producing a winding signal. A further effect is that also in the case of a slow insertion, which does not happen very often, the yarn pulses reliably lead to winding signals because before each yarn pulse the yarn acceptance is adjusted for weak yarn pulses, and a contamination following the yarn does not lead to a wrong winding signal because in such a case the yarn acceptance is then set for strong winding signals.

In a further variant, the time within which a weak interference pulse uses to occur is, so to speak, cut out in a technical control process simply by means of the time window. The time window is, for instance, set to 3 ms, i.e., a duration which is shorter than the shortest time interval between two successive winding signals of the insertion cycle, typically at least 10 ms.

Another variant is simple and reliable with respect to control. Upon detection of the at least first winding signal, the upshifting signal is supplied to the filter assembly so that the assembly operates with the second filtering mode for the further yarn pulses. The upshifting signal may be produced with a time delay. Downshifting into the first filtering mode is carried out after expiration of the time window and prior to the occurrence of the next yarn pulse by means of suppressing the upshifting signal.

The filtering means is a band-pass filter assembly having two different bandwiths, with the lower limit of a bandwith being respectively adjusted to the rapidity of the yarn pulse and to the slowness or weakness of the interference pulses to be able to make a distinction between the two.

Where the band-pass filter assembly is connected to a microprocessor, the band-pass filtering means is switched over by the microprocessor as soon as the at least first or each winding signal has been produced.

In another embodiment, the filter assembly is permanently switched back and forth between the two filtering modes in such a manner that prior to the generation of a yarn pulse the filtering mode is set with acceptance of also a slow or weak yarn pulse, whereas upon generation of the winding signal and for the duration of the time window the filtering mode remains set with acceptance of only strong yarn pulses. Hence, interference pulses can be filtered out, and above all a very rarely occurring slow insertion into the weaving machine can be mastered without slow insertion into the weaving machine can be mastered without any detection errors.

The embodiment wherein the control circuit includes an active amplifier and band-pass filter assembly is particularly expedient because the active amplifier and band-pass filter assembly lead to uniformly strong and significant winding signals and avoids performance losses during filtering.

The band-pass filter assembly is designed with response characteristics including a high-pass filtering mode and a low-pass filtering mode following said high-pass filtering mode without any interruption. A significant d.c. level which up to higher frequencies remains approximately constant around about 100 kHz is thereby obtained up to frequencies of, for instance, less than 1.0 kHz. The low-pass filtering mode can be disabled to change the response characteristics such that frequencies of, for instance, clearly less than 10 kHz or a frequency of about 1.0 kHz no longer lead to any significant d.c. level, but only frequencies of between about 10 khZ and shortly below 100 kHz lead to similarly high or higher d.c. levels as in the effective low-pass filtering mode. This can easily be achieved with a control means by varying the resistance characteristics of the two resistors; of special importance is here the fact that analog circuit components to which the two resistors are connected ensure that the d.c. level in the band-pass filter assembly is kept constant and does not drift off because of the switching between the two modes. In other words, the band-pass filter assembly has response characteristics which first lead via a relatively broad frequency range to a significant d.c. level, but, in case of need, are temporarily restricted by disabling the low-pass filtering mode to a narrow frequency range near the upper cut-off frequency, so that only higher frequencies lead to usable d.c. levels. In a disabled low-pass filtering mode, the interference pulses at lower frequencies can thus be filtered out at lower frequencies, because only the yarn pulses with the correspondingly high frequencies lead to high d.c. levels.

The bandwiths are dimensioned such that the yarn speeds which are normally high in modern weaving machines can be mastered without any difficulty.

Further, it is ensured that the band-pass filter assembly respectively operates at the beginning of the insertion process and before each yarn pulse in the first filtering mode.

In an alternative simple embodiment, there is switching between the band-pass filters, depending on whether the yarn moves at a low speed or at a high speed or whether or not the yarn has passed the withdrawal sensor.

Further, the withdrawal sensor serves to control the stop device to exactly dimension the yarn length. The receiver is positioned closely behind the stop device to report the proper passage of the yarn as early as possible.

Also, the receiver is offset in the axial direction of the storage drum relative to the stop element of the stop device, expediently at the side of the stop element which faces the yarn reservoir, in order to obtain a yarn geometry with an obliquely extending yarn in the activated state of the stop, the yarn geometry being such that a specific amount of time will elapse upon deactivation of the stop element until the yarn has passed the receiver. Thanks to this elapsed time and on account of the strong acceleration at the beginning of the yarn insertion cycle, the passage speed at the receiver will then be already so high that a relatively strong first yarn pulse is generated.

By contrast, the two alternately or jointly activated receivers are provided at both sides of the stop device in order to achieve an even higher accuracy during scanning. Each winding signal is derived from two successive yarn pulses. This arrangement allows changing of the rotational withdrawal direction as well.

The withdrawal sensor can be adapted to the respective yarn quality, with an undesired interaction between the change in acceptance or the switching between the filtering modes and the sensitivity adjustment being avoided by uncoupling. The sensitivity must be adjusted because different yarn qualities may lead to different yarn pulses, e.g. because of different reflective characteristics or densities.

The withdrawal sensor expediently operates in an optoelectric manner. However, it is also possible to scan the yarn without contact by ultrasound, in a capacitive, inductive or piezoelectric manner, or with contact. A precondition is that the receiver is capable of producing yarn pulses having a specific pulse shape or a specific curve of the leading ramp.

We claim:

1. A method of scanning a yarn of predetermined length which is intermittently withdrawn during insertion cycles of a weaving machine from a winding reservoir provided on a storage drum of a weft-yarn feeding device, said weft-yarn feeding device including a withdrawal sensor which produces yarn pulses wherein at least one said yarn pulse is produced during passage of the yarn within one insertion cycle, said withdrawal sensor further producing interference pulses due to passing particles including dirt, said weft-yarn feeding device including a circuit wherein a winding signal is derived respectively from said yarn pulse and is transmitted to a signal-processing device, the method comprising the steps of:

providing a band-pass filter assembly in said circuit which said band-pass filter assembly has a yarn pulse acceptance which permits acceptance of said yarn pulses which are relatively slow and weak;

accepting at least a first one of said yarn pulses with said band-pass filter assembly; and changing said yarn pulse acceptance of said band-pass filter assembly with an increasing yarn speed and/or upon generation of at least a first said winding signal which corresponds to said first yarn pulse; and said yarn pulse acceptance after said changing permitting acceptance by said band-pass filter assembly of further said yarn pulses which are relatively fast and strong and preventing acceptance of said interference pulses which are relatively slower or weaker in comparison with said further yarn pulses to suppress false winding signals caused by said interference pulses.

2. The method according to claim 1, wherein said band-pass filter assembly has first and second filtering modes, said changing step including upshifting said band-pass filter assembly from said first filtering mode to said second filtering mode at an increasing yarn speed, said band-pass filter assembly when in said first filtering mode accepting at least said first yarn pulse which is relatively slow and weak and when in said second filtering mode accepting said further yarn pulses which are relatively fast and strong, said second filtering mode being predetermined such that said interference pulses which are slower or weaker are filtered out with respect to said further yarn pulses which are faster or stronger.

3. The method according to claim 2, further comprising the steps of adjusting the yarn pulse acceptance prior to the occurrence of each said winding signal, at least during an initial acceleration phase of said insertion cycle, so that said band-pass filter assembly accepts said yarn pulses which are relatively weak, and thereafter adjusting the yarn pulse acceptance upon the occurrence of said winding signal to again accept said yarn pulses which are stronger and faster and prevent acceptance of said interference pulses.

4. The method according to claim 3, further comprising the step of maintaining said yarn pulse acceptance for faster and stronger yarn pulses for the duration of a time window which is shorter than a shortest time period between two said winding signals of said insertion cycle which occur successively.

5. The method according to claim 4, further comprising the steps of supplying an upshifting signal to said band-pass filter assembly in response to at least said first winding signal, said upshifting signal being maintained for the duration of said time window.

6. In a withdrawal sensor for a weft-yarn feeding device which said weft-yarn feeding device comprises a storage drum for a winding reservoir and is used for intermittently feeding yarn of an adjusted yarn length to a weaving machine during insertion cycles, said withdrawal sensor comprising at least one receiver which during each said insertion cycle is responsive to passage of said yarn to generate yarn pulses and also generates interference pulses in response to passing particles, said withdrawal sensor further comprising a circuit which is assigned to said receiver and in which winding signals can be produced from said yarn pulses, and a device which is connected to said withdrawal sensor for processing said winding signals, comprising the improvement wherein said circuit comprises a filter assembly having at least first and second selective filtering modes which differ with respect to whether said filter assembly accepts said yarn pulses which are strong or weak, said filter assembly including a switching device which switches said filter assembly from said first filtering mode to said second filtering mode due to an increasing yarn withdrawal speed or after at least a first detected yarn passage, said filter assembly when in said first filtering mode accepting at least a first one of said yarn pulses which is relatively slow and weak, and said filter assembly when in said second filtering mode accepting said yarn pulses, which are relatively fast and strong while not accepting said interference pulses.

7. The withdrawal sensor according to claim 6, wherein said filter assembly comprises a band-pass filter assembly which prevents acceptance of said interference pulses when in said second filtering mode, said interference pulses being relatively slow or weak in comparison to said fast and strong yarn pulses which are accepted by said band-pass filter assembly when in said second filtering mode, said band-pass filter assembly accepting any of said yarn pulses in either of said first and second filtering modes which are below a predetermined upper yarn speed limit.

8. The withdrawal sensor according to claim 7, wherein said device comprises a microprocessor and said band-pass filter assembly is connected to said microprocessor which is fed with said winding signals, an upshifting signal being in a stand-by condition in said microprocessor and said upshifting signal being transmitted by said microprocessor to said band-pass filter assembly after receipt of at least a first said winding signal or each said winding signal.

9. The withdrawal sensor according to claim 7, wherein said filter assembly is switched with each said winding signal, at least within an initial acceleration phase of said insertion cycle, with an upshifting signal from said first filtering mode wherein said yarn pulses which are relatively slow and weak are accepted to said second filtering mode wherein said yarn pulses which are relatively fast and strong are accepted and interference pulses are not accepted, said filter assembly being held in said second filtering mode for a duration of a time window, and an adjustable timing or counting member being provided to define said time window which said timing or counting member operates upon generation of said winding signal.

10. The withdrawal sensor according to claim 6, wherein said circuit is an active amplifier and band-pass filter assembly.

11. The withdrawal sensor according to claim 7, wherein said band-pass filter assembly is provided with a high-pass filtering mode and a low-pass filtering mode of which said low-pass filtering mode can be disabled by an upshifting signal, said band-pass filter assembly including resistors which are arranged in parallel and connected to analog circuit components and whose resistance characteristics are controlled by applying said upshifting signal to said analog circuit components such that only said high-pass filtering mode is operative when said low-pass filtering mode is disabled.

12. The withdrawal sensor according to claim 7, wherein said band-pass filter assembly includes upper and lower passage frequencies that which by said filter assembly, said band-pass filter assembly having means for elevating said lower passage frequency by an upshifting signal from a predetermined basic value to a predetermined maximum value, said basic value corresponding to a yarn speed of about 2 m/s for said first filtering mode and said maximum value corresponding to a yarn speed of about 10 m/s for said second filtering mode, said upper passage frequency being respectively at a frequency corresponding to a yarn speed of about 120 m/s.

13. The withdrawal sensor according to claim 7, wherein said switching device is connected to said circuit such that said band-pass filter assembly is reset by said switching device into said first filtering mode upon a standstill of said yarn or expiration of a time period defined by said circuit.

14. The withdrawal sensor according to claim 7, wherein said band-pass filter assembly comprises frequency band filters having different high and low cut-off frequency settings, said frequency band filters corresponding to said first and second filtering modes respectively wherein said switching device switches between said frequency band filters, said switching device including means for operating said switching device in response to a yarn withdrawal speed or generation of at least said first winding signal or each said winding signal.

15. The withdrawal sensor according to claim 7, wherein said circuit comprises an adjusting device for adjusting a scanning sensitivity of said withdrawal sensor which is dependent on yarn quality, said adjusting device being uncoupled from said band-pass filter assembly by virtually grounded analog circuit components for separately feeding sensitivity and upshifting signal levels.

16. In a weft-yarn feeding device which said weft-yarn feeding device comprises a storage drum for a winding reservoir and is used for intermittently feeding yarn of an adjusted yarn length to a weaving machine during insertion cycles, said weft-yarn feeding device including a withdrawal sensor comprising at least one receiver which during each said insertion cycle is responsive to passage of said yarn to generate yarn pulses and also generates interference pulses in response to passing particles, said withdrawal sensor further comprising a circuit which is assigned to said receiver and in which winding signals can be produced from said yarn pulses, and a device which is connected to said withdrawal sensor for processing said winding signals, comprising the improvement wherein said circuit comprises a filter assembly having at least first and second selective filtering modes which differ with respect to whether said filter assembly accepts said yarn pulses which are strong or weak, said filter assembly including a switching device which switches said filter assembly from said first filtering mode to said second filtering mode due to an increasing yarn withdrawal speed or after at least a first detected yarn passage, said filter assembly when in said first filtering mode accepting at least a first one of said yarn pulses which is relatively slow and weak, and said filter assembly when in said second filtering mode accepting said yarn pulses, which are relatively fast and strong, while not accepting said interference pulses.

17. The withdrawal sensor according to claim 16, wherein said weft-yarn feeding device includes a stop device which is assigned to said storage drum and is adapted to be moved back and forth between a stop position and a passive position for said yarn for defining in said yarn feeding device the predetermined yarn length for each said insertion cycle, said receiver being arranged a short distance from said stop device in the direction of motion of said yarn during withdrawal, said receiver being connected via said circuit to at least one control device of said stop device.

18. The withdrawal sensor according to claim 17, wherein two said withdrawal sensors are provided, one of said withdrawal sensors being positioned a short distance in front of a stop element of said stop device in a direction of motion of said yarn and another of said withdrawal sensors being a short distance behind said stop element.

19. The withdrawal sensor according to claim 17, wherein said receiver is axially offset relative to a stop element of said stop device in an axial direction of said storage drum.

* * * * *

UNITED STATES PATENT AND TRADEMARK OFFICE
CERTIFICATE OF CORRECTION

PATENT NO : 6 068 028
DATED : May 30, 2000
INVENTOR(S) : Ignace DE RO, et al.

It is certified that error appears in the above-identified patent and that said Letters Patent are hereby corrected as shown below:

Column 12, line 30; change "that which" to ---that define said yarn pulses which are accepted---.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*